US005369216A

United States Patent [19]

Miyamoto

[11] Patent Number: 5,369,216

[45] Date of Patent: Nov. 29, 1994

[54] ELECTRONIC MUSICAL INSTRUMENT HAVING COMPOSING FUNCTION

[75] Inventor: Hiromu Miyamoto, Hamamatsu, Japan

[73] Assignee: Yamaha Corporation, Hamamastu, Japan

[21] Appl. No.: 23,485

[22] Filed: Feb. 25, 1993

Related U.S. Application Data

[63] Continuation of Ser. No. 813,854, Dec. 26, 1991, abandoned.

[30] Foreign Application Priority Data

Dec. 28, 1990 [JP] Japan ..... 2-416781

[51] Int. Cl.[5] ..... G10H 7/00

[52] U.S. Cl. ..... 84/609

[58] Field of Search ..... 84/609–614, 84/634–638; 369/47

[56] References Cited

U.S. PATENT DOCUMENTS 3,760,088 9/1973 Nakada .
4,326,441 4/1982 Imamura et al. .
4,466,324 8/1984 Okamoto et al. ..... 84/609
4,656,535 4/1987 Usui ..... 369/47 X
4,903,565 2/1990 Abe ..... 84/611
4,953,438 9/1990 Shibukawa ..... 84/609
4,960,030 10/1990 Fujimori ..... 84/609

FOREIGN PATENT DOCUMENTS 55-38571 3/1980 Japan .
57-130092 8/1982 Japan .

*Primary Examiner*—Stanley J. Witkowski
*Attorney, Agent, or Firm*—Spensley Horn Jubas & Lubitz

[57] ABSTRACT

An electronic musical instrument includes a first memory for storing a plurality of performance data, each containing at least one measure, performance data designation apparatus for designating selected ones of the plurality of performance data stored in the first memory, and a for reading out the performance data designated by the designation apparatus from the first memory. A second memory stores the read-out performance data or a code data representing the read-out performance data, a tone generator generates musical tones on the basis of performance data, and control apparatus controls the tone generator to generate a performance sound based on the read-out performance data under the condition that the read-out performance data is enabled to be written into the second memory, in order to grasp a real tune of performance data by listening to it during song composition.

11 Claims, 9 Drawing Sheets

| REGISTERS | |
|---|---|
| SONG | SONG NO. |
| PTN | PATTERN NO. |
| SPLAY | SONG PLAY FLAG |
| PPLAY | PATTERN PLAY FLAG |
| END | SONG END FLAG |

ELECTRONIC MUSICAL INSTRUMENT HAVING COMPOSING FUNCTION

This is a continuation of application Ser. No. 07/813,854, filed on Dec. 26, 1991, now abandoned.

BACKGROUND OF THE INVENTION

1. Field of the Invention

The present invention generally relates to an electronic musical instrument and particularly relates to an electronic musical instrument having a function of composing performance data of auto rhythm or auto song and a function of storing the performance data.

2. Description of the Related Art

In most electronic musical instruments, provided is memory means for storing performance data once performed so that automatic performance can be made by reproducing the stored performance data.

In some electronic musical instrument, provided is a function of storing a plurality of performance data each containing at least one measure to make it possible to compose one song by reading suitable ones selected from the stored plurality of performance data and by combining the read-out suitable ones. The plurality of performance data are numbered or named and these pattern numbers or names are successively designated so that the order of a performance can be stored as sequence data.

If there is no identification means other than such pattern numbers or names at the time of the designation of patterns to compose a song, the real tune of the patterns to be designated cannot be known without storing the relations between the patterns and the pattern numbers in advance or without interrupting the song composing operation to listen to the patterns. Therefore, difficulty is in the song composing operation.

Furthermore, it is so difficult to grasp the image of the song to be composed that the patterns to be designated may be mistaken to make the song composing efficiency worse.

SUMMARY OF THE INVENTION

An object of the present invention is to provide an electronic musical instrument having a function of composing a song while grasping the real figures of designated patterns.

According to an aspect of the invention, there is provided an electronic musical instrument which comprises: first memory means for storing a plurality of performance data each containing at least one measure; performance data designation means for designating selected ones of the plurality of performance data stored in the first memory means; reader means for reading out the performance data designated by the designation means from the first memory means; second memory means for storing the read-out performance data or a code data representing the read-out performance data; tone generator means for generating musical tones on the basis of a performance data; and control means for controlling the tone generator means to generate a performance sound based on the read-out performance data under the condition that the read-out performance data is enabled to be written into the second memory means.

If selected ones of the plurality of performance data are designated by the designation means, the designated performance data are read from the first memory means and controlled by the control means so as to be generated as a performance sound from the tone generator means under the condition that the read-out performance data is kept enabled to be written into the second memory means. If the performance data are correct one, the performance data are stored in the second memory means.

Because a song can be composed while the real tune of the designated performance pattern is grasped by listening it actually during song composition, the image of the song can be grasped easily to prevent composing mistakes.

As a result, the song composing efficiency can be improved.

DESCRIPTION OF THE PREFERRED EMBODIMENT

Figure 1:
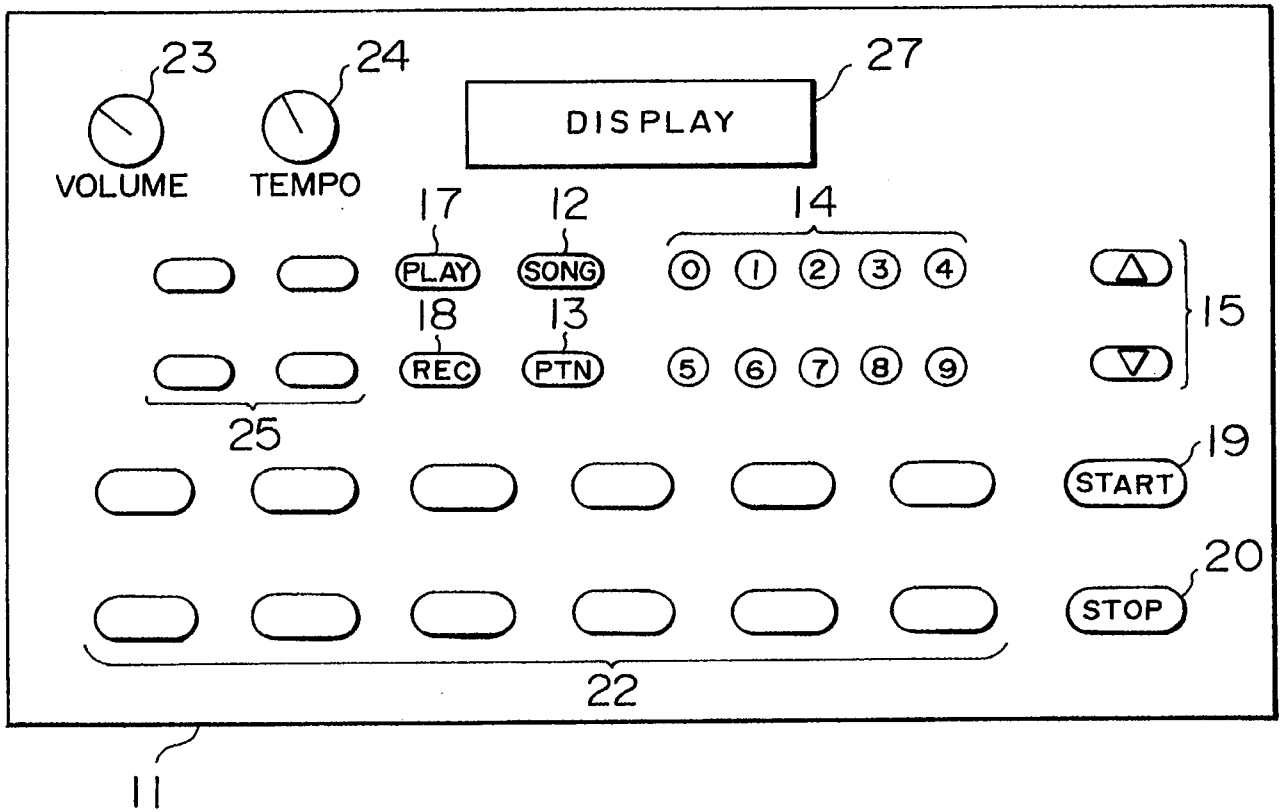
FIG. 1 is a schematic view of a front panel of a song composer.

Referring to FIG. 1, there is shown a rhythm song composer portion of an electronic musical instrument as an embodiment of the present invention. The song composer 11 has a front panel on which various keys, indicators and adjusters are provided.

A song key 12 is a key for designating a song number. A pattern key 13 is a key for designating a pattern number. If, for example, the "2" key and the "0" key of numeric keys 14 are successively pressed after the pattern key 13 is pressed, a 20th-order pattern is read out. The reading of the pattern may be selected by the numeric keys 14 as described above or may be selected by increasing or decreasing the pattern number indicated by a display 27 through a cursor key 15. This selecting method can be also applied to song selection.

A play key 17 is a key for designating a play mode. A record key 18 is a key for designating a record mode. A start key 19 and a stop key 20 are provided for actually executing and slopping playing/recording respectively. The start key 19 is a key for starting the playing of the selected pattern and the stop key 20 is a key for stopping the playing.

Instrument keys 22 are keys for selecting musical tones of instruments such as a bass drum, a high hat close, a high hat open, cymbals 1, 2, 3, a snare drum, a tom tom high, a tom tom low, a floor tom tom, a synthesizer drum, a rim shot, etc. The musical tones of the instruments are respectively generated by pressing these keys. A volume controller 23 for controlling sound volume and a tempo controller 24 for controlling tempo are further provided. Other keys 25 are further provided on the front panel.

Figure 2:
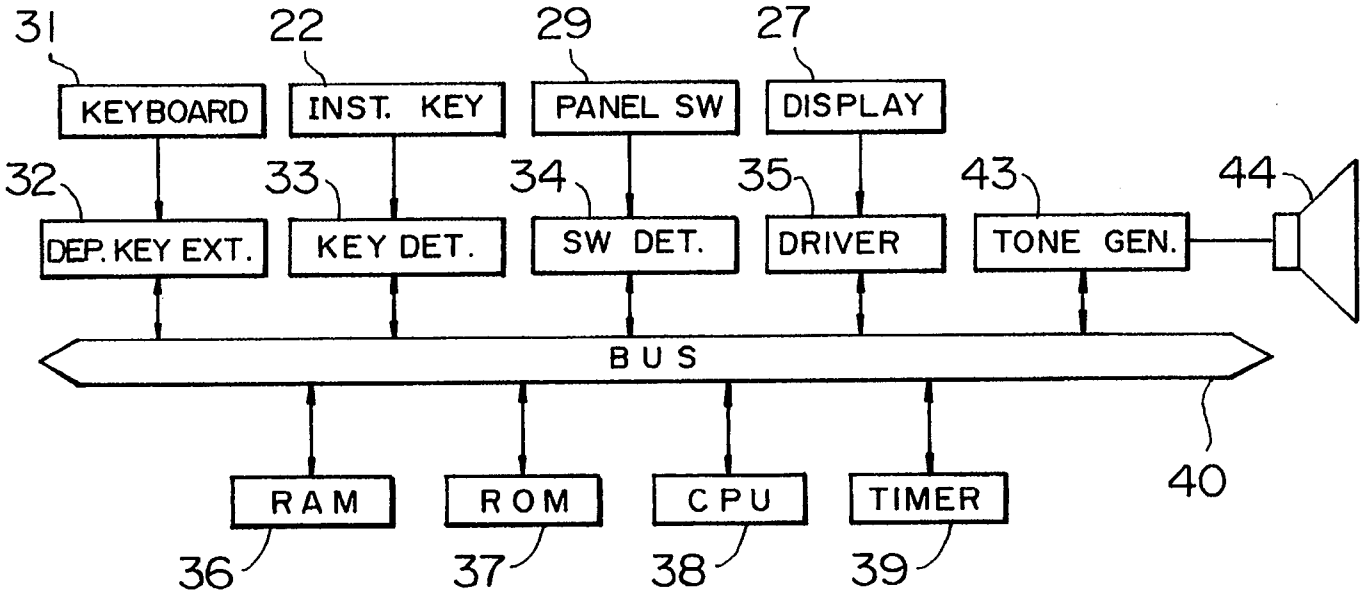
FIG. 2 is a block diagram showing the circuit configuration of an electronic musical instrument.

The circuit configuration of the electronic musical instrument is schematically shown in FIG. 2. The instrument keys 22 shown in FIG. 1 are connected to a key detection circuit 33 for detecting the instrument key operated. The operations of other switches 29, such as keys 12 to 15, 17 to 20 and 25 manipulators 23 and 24, etc., are detected by a switch detection circuit 34. A keyboard 31 for ordinary performance is further provided in the electronic musical instrument so that the key operation such as key depression and key release on the keyboard is detected by a depressed key detection circuit 32.

The playing operation or the song composing operation is carried out through the arithmetic operation of a CPU 38. For example, tone generation parameters are supplied to a tone generator 43 to generate a tone signal to thereby generate a musical tone from a sound system 44. An ROM 37 is a memory for storing programs such as song composing programs, tone generating programs, etc.

An RAM 6 is a memory for temporarily storing intermediate results of the arithmetic operation, input data and the like. A pattern memory, a song memory and registers which will be described later are stored in the RAM 36. Alternatively, part of the pattern memory and part of the song memory may be stored in the ROM 37. The timing of playing or storing the patterns and the song is controlled on the basis of a timing signal given by a timer 39. These constituent circuits are connected to each other through a bus 40.

Figures 3, 4:
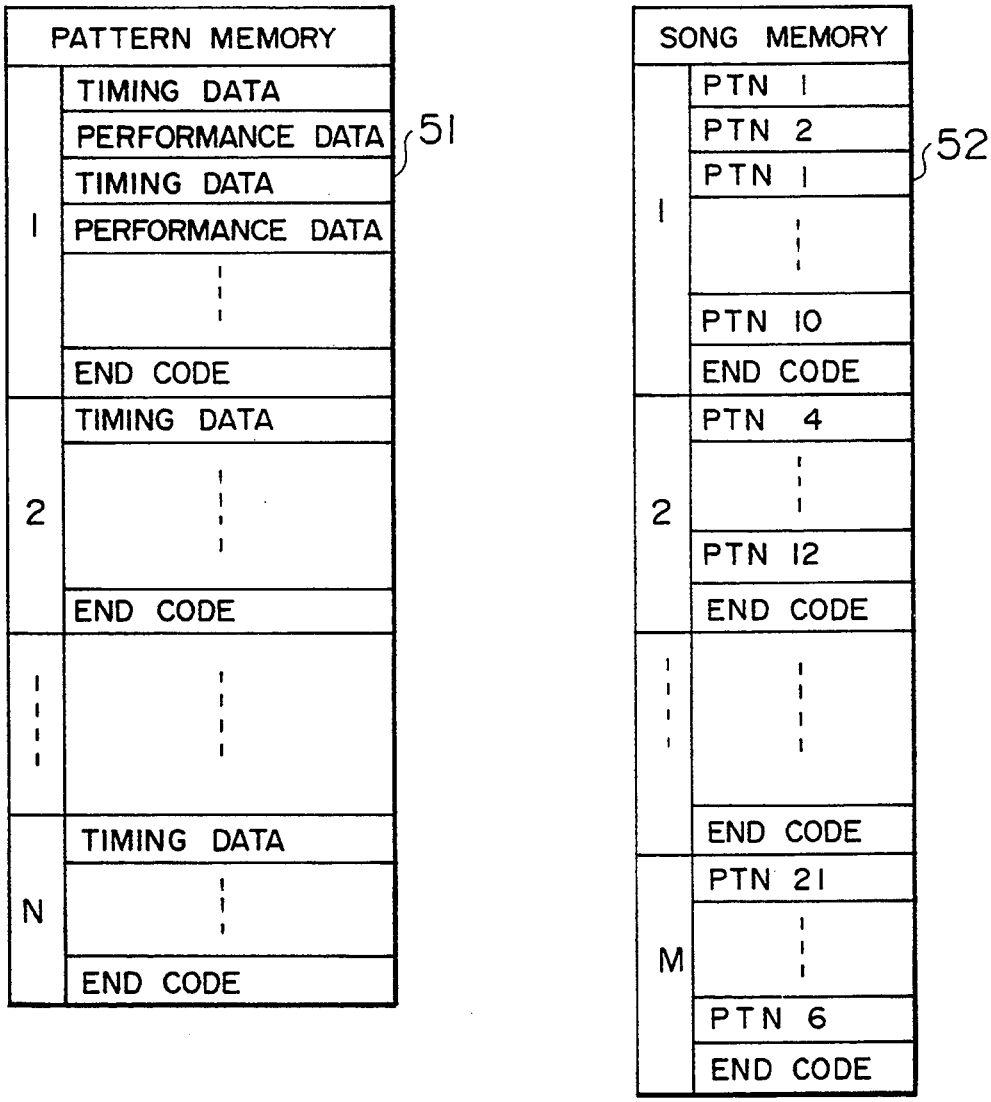
FIG. 3 is a schematic view showing the respective configurations of a pattern memory and a song memory in an RAM.
FIG. 4 is a view showing an example of the register configuration in the RAM.

The configurations of the pattern memory 51 and the song memory 52 used in the song composing mode are schematically shown in FIG. 3.

The pattern memory 51 has a plurality of blocks (for example, N blocks) each of which stores one pattern. With respect to one pattern, an end code is stored after performance data with the length of one or several measures is stored through recording combinations of timing data and performance data such as a tone color, a tone volume, etc. Suitable ones of these patterns are selected and edited to compose a song. Empty patterns having no information may be prepared in the pattern memory so that the player can freely compose desired patterns in the empty patterns.

The song memory 52 stores a plurality of songs composed of combinations of respective patterns. With respect to one song, a sequence of patterns is stored in the form of a train of pattern numbers. One song ends with an end code.

Registers formed in the RAM 36 are partly shown in FIG. 4. A song register SONG is a register for storing a song number. A pattern register PTN is a register for storing pattern numbers.

A flag SPLAY is a register for storing a song play flag which is set to "1" during the execution of song playing. A flag PPLAY is a register for storing a pattern play flag which is set to "1" during the execution of pattern playing.

A flag END is a register for storing a song end flag which is set to "1" when a song is finished. Other necessary registers are provided in the RAM 36.

The routine of composing a song by using the electronic musical instrument as shown in FIGS. 1 and 2 will be described hereunder with reference to a flow chart.

Figure 5:
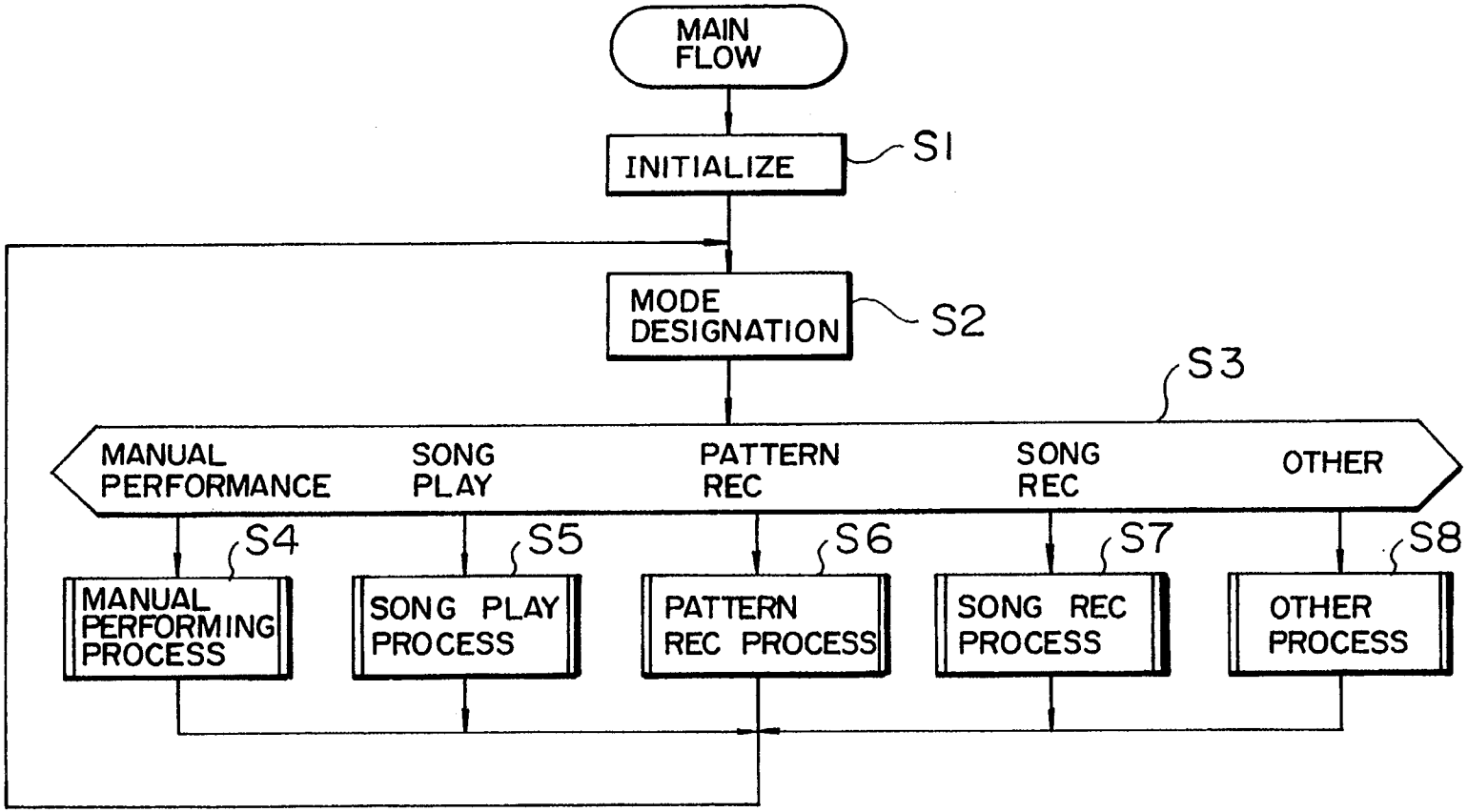
FIG. 5 is a flow chart of the main routine.

FIG. 5 shows a flow chart of the main routine.

When the routine starts, registers are initialized in a step S1. Then, in a step S2, a mode designation process is carried out. If a new mode is designated in this step, the designation of the mode is detected and transferred to the next step. If no new mode is designated, the previous mode is designated.

In a step S3, mode judgment is performed in accordance with the detected mode designation to thereby perform branching of operation on the basis of the result of the mode judgment. If, for example, a manual play mode is designated, a step S4 is selected to carry out a manual playing process.

If a song play mode is designated, a step S5 is selected to carry out a song playing process. If a pattern record mode is designated, a step S6 is selected to carry out a pattern recording process. If a song record mode is selected, a step S7 is selected to carry out a song recording process. If another mode is designated, a step S8 is selected to carry out another process. Upon termination of such a process, the situation of the routine returns to the step S2.

The contents of the respective processes will be described hereunder with reference to flow charts.

Figure 6:
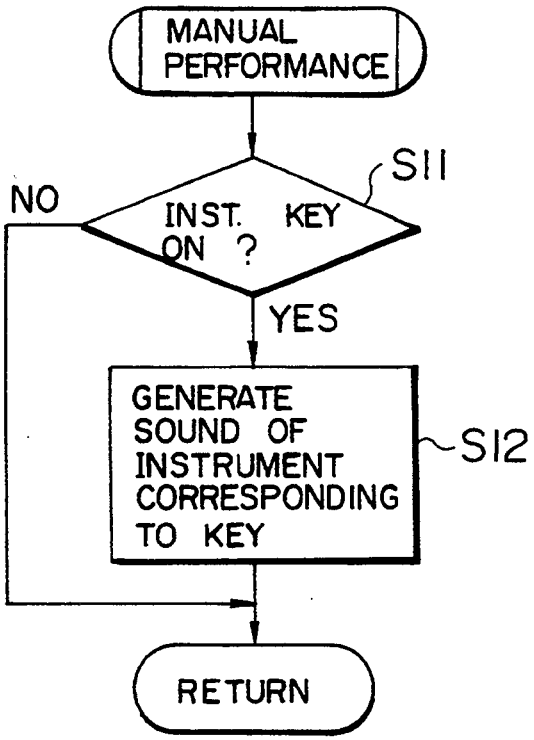
FIG. 6 is a flow chart of the manual performance routine.

FIG. 6 shows a flow chart of the manual playing process. When the manual playing process starts, a judgment is made as to whether some instrument key is on or off. If some instrument key is on, the situation of the routine goes to the next step S12 to carry out a process of generating a musical tone of an instrument corresponding to the depressed key. Then, the situation of the routine returns. If no instrument keys are on, the situation of the routine returns soon.

As described above, a rhythm instrument can be played manually.

Figure 7:
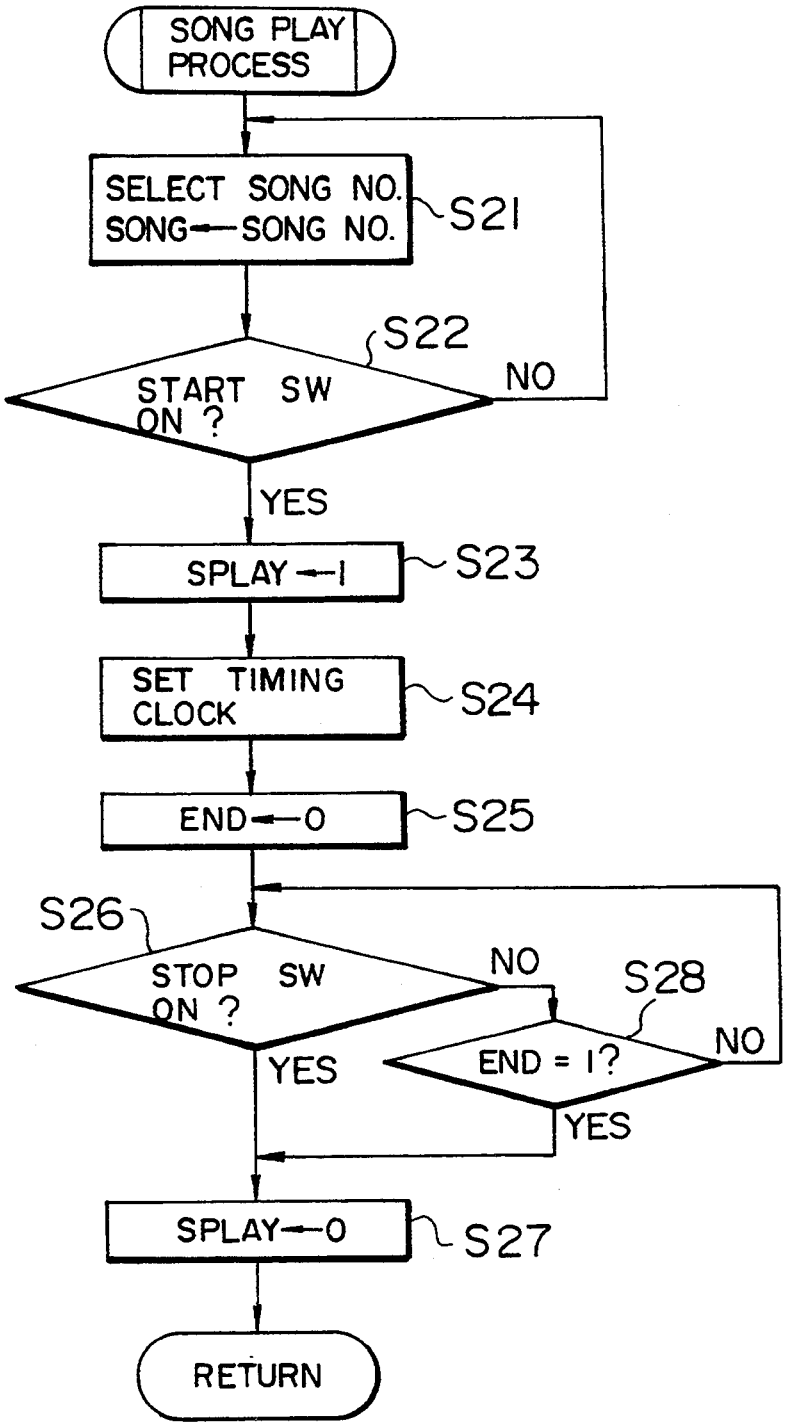
FIG. 7 is a flow chart of the song playing routine.

FIG. 7 shows a flow chart of the song playing process.

In a step S21, if a song number is designated through the song key 12 and the numeric keys 14 or through the song key 12 and the up/down cursors 15, the song number is stored in the register SONG.

Then, in a step S22, a judgment is made as to whether the start key 19 shown in FIG. 1 is on or off. If the start key 19 is off, the situation of the routine returns to repeat the step S22. If the start key 19 is on, on the contrary, the situation of the routine goes to the next step S23 to set the song play Flag SPLAY to "1". Then, in a step S24, a timing clock pulse signal is set. At this time, data are read out by means of timer interruption which will be described later, to start playing. In a step S25, the flag END is set to "0" to indicate that the playing is not terminated, or in other words, to indicate that the playing is active now. In this condition, the playing is continued.

Then, in a step S26, a judgment is made as to whether the stop key 20 shown in FIG. 1 is on or off. If the stop key 20 is pushed down, the situation of the routine goes to a step S27 soon to set, the song play flag SPLAY to "0" and then terminate the playing.

If the stop key 20 is off, a judgment is made as to whether the flag END is "1" or not (a step S28) to thereby judge whether the playing is terminated or not. If "1" is stored in the flag END because the playing is terminated, the song play flag SPLAY is set to "0" (the step S27) and then the playing is terminated. If not only the stop switch is off but the playing is continued (the flag END is "0"), the situation of the routine goes from the step S28 back to the step S26 to continue the playing. Thus, the process of playing a read song is carried out.

Figure 8:
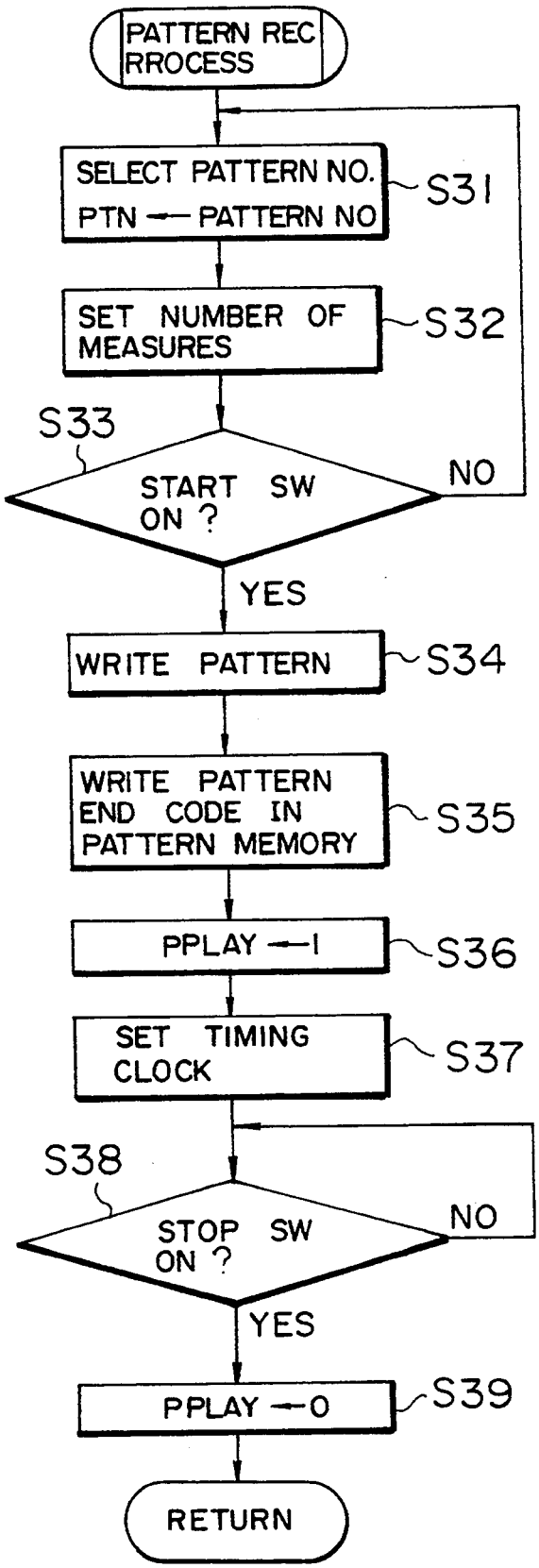
FIG. 8 is a flow chart of the pattern recording routine.

FIG. 8 shows a flow chart of the pattern recording process. In a step S31, when a pattern number is selected through the pattern key 13 and the numeric keys 14 or through the pattern key 13 and the up/down cursors 15, the pattern number is stored in the pattern register PTN. Then, the number of measures contained the pattern to be recorded in the pattern register is designated in a step S32.

Then, a judgment is made as to whether the start key 19 is on or off (a step S33). If the start key is off, the step S33 is repeated. If the start key is pushed down to turn on the start switch, the situation of the routine goes to a step S34 to carry out a pattern writing process. For example, input data from the keyboard or the like may be used as real-time performance data. If the generated pattern is written until the last measure based on the designated number of measures is filled, the situation of the routine goes to a step S35 to write a pattern end code in the last position of the pattern memory and then terminate the recording process.

Then, the pattern play flag is set to "1" (a step S36) and a timing clock pulse signal is set (a step S37) to start the playing of the recorded pattern at the time of the next timer interruption. The pattern designer can confirm whether the generated pattern accords with the designer's will. When the playing is to be stopped, the stop key 20 is pushed down.

Then, in a step 38, a judgment is made as to whether the stop key 20 is pushed down to turn on the stop switch or not. If the stop key 20 is not pushed down, the playing is continued. If the stop key is pushed down to turn on the stop switch, the situation of the routine goes to a step S39 to set the pattern play flag PPLAY to "0" and then terminate the playing. Then, the situation of the routine returns.

As described above, in the pattern recording process, when the start switch is turned on, pattern writing starts to record patterns correspondingly to the predetermined measures. Then, a tone generating process is carried out to certify the written patterns.

Figure 9:
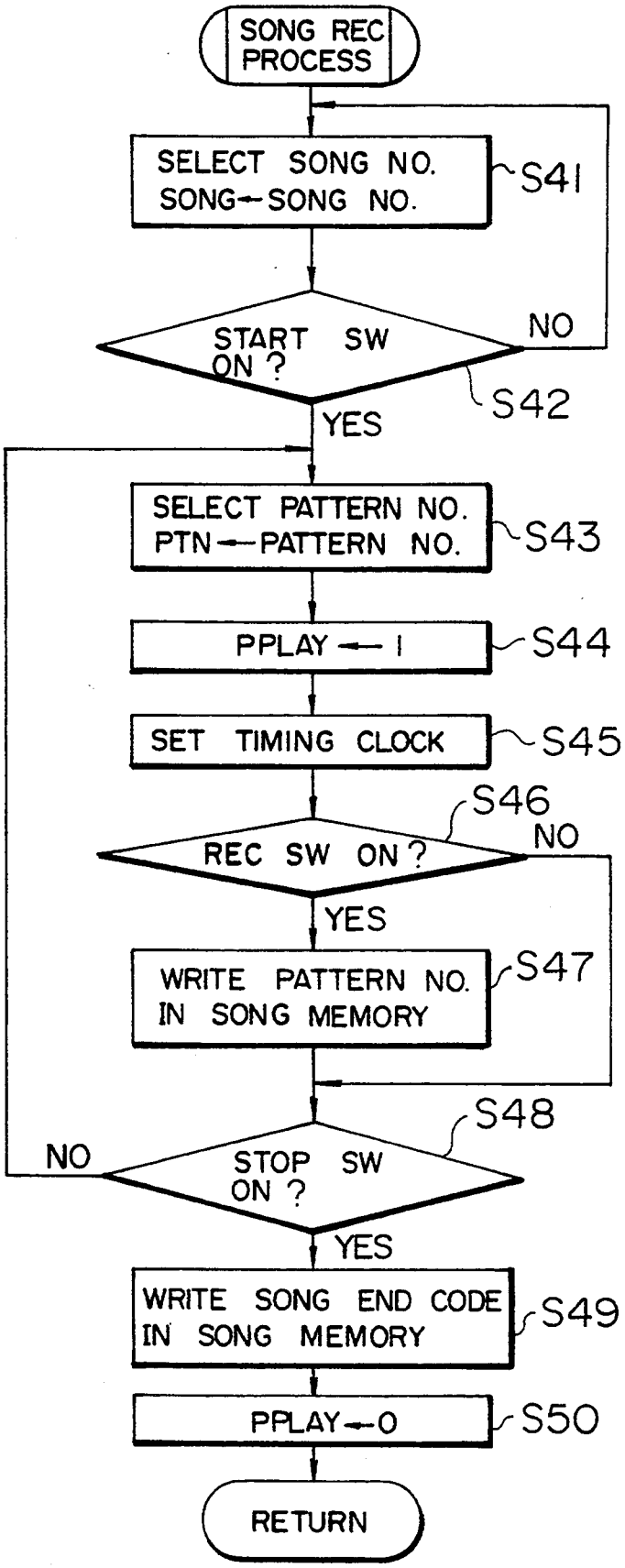
FIG. 9 is a flow chart of the song recording routine.

FIG. 9 shows a flow chart of the song recording process. If a song number is selected through the song key 12 and the numeric keys 14 or through the song key 12 and the up/down cursors 15 shown in FIG. 1, the song number is stored in the song register SONG (a step S41).

Then, in a step S42, a judgment is made as to whether the start key 19 is pushed down to turn on the start switch or not. If the start switch is off, this step is repeated. If the start key 19 is pushed down to turn on the start switch, the situation of the routine goes to a step S43 to select the number of a pattern as a constituent member of a song and store the pattern number in the pattern register PTN.

Then, in a step S44, the pattern play flag is set to "1" and timing clock pulse signal is set to make preparation for starting of the playing at the time of the next timer interruption (a step S45). When timer interruption occurs, pattern playing starts.

In a step S46, a judgment is made as to whether the record switch 18 is pushed down to turn on the record switch or not. If the record switch is on, the situation of the routine goes to a step S47 to write the pattern number in the song memory.

Then, a judgment is made as to whether the stop key 20 is pushed down to turn on the stop switch or not (a step S48). If the stop key is off, the situation of the routine goes back to the step S43.

If the record key 18 is not pushed down, the situation of the routine goes from the step S46 to the step S48. If the record key 18 and the stop key 20 arc not pushed down, the procedure of from the step S43 to the step S48 is repeated.

If the stop key 20 is pushed down, the situation of the routine goes to step S49 to write a song end code in the song memory. The end of the song is indicated by this code.

Then, in a step S50, the pattern play flag PPLAY is set to "0" and then the playing is terminated. Then, the situation of the routine returns.

Figure 10:
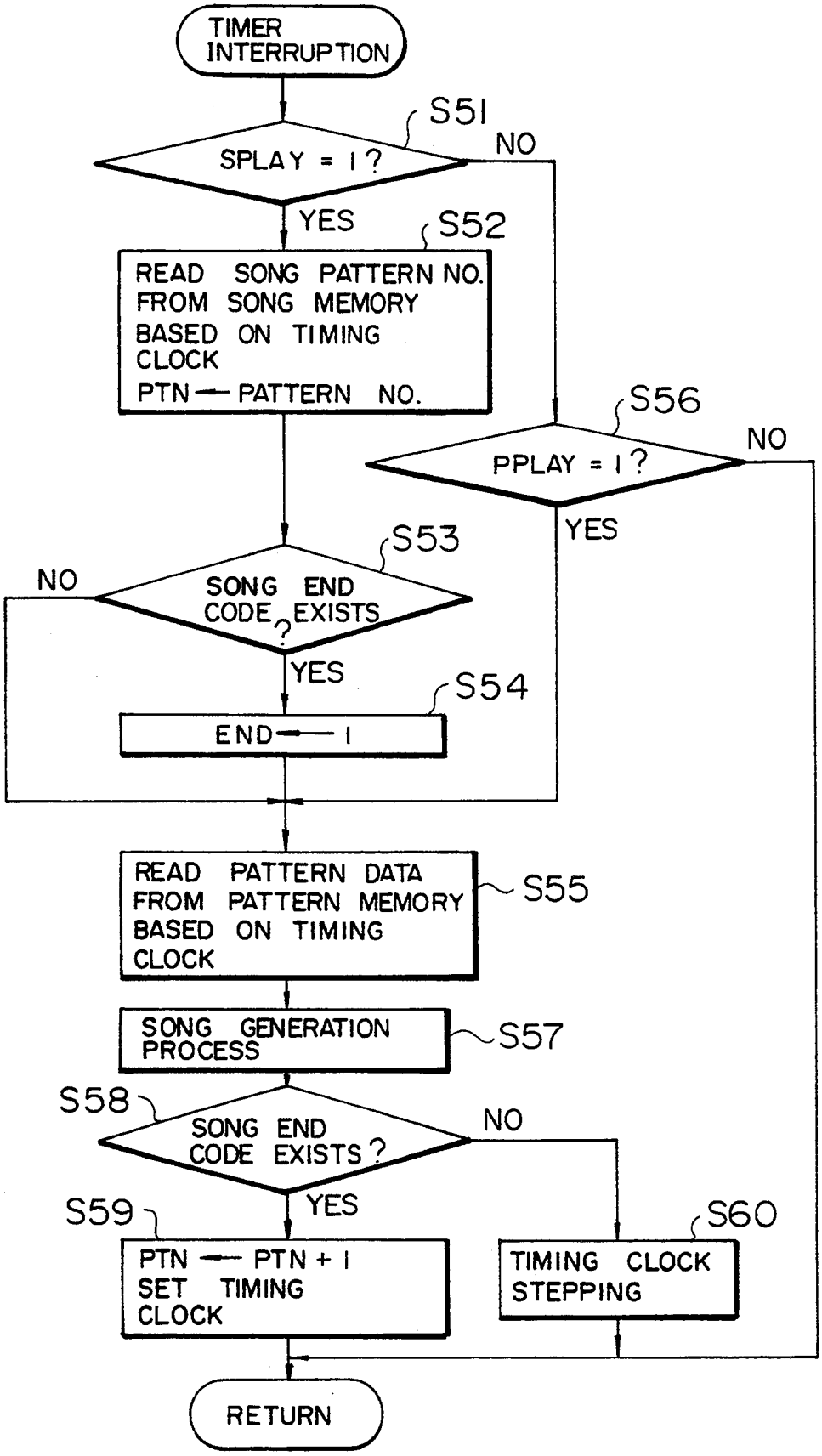
FIG. 10 is a flow chart of the timer interruption routine.

FIG. 10 shows a flow chart of the timer interruption routine. When timer interruption occurs, a judgment is made as to whether the song play flag SPLAY is "1" or not (a step S51). That is, a judgment is made as to whether song playing is designated or not. If song playing is designated, the situation of the routine goes to a step S52 to successively read song pattern numbers from the song memory on the basis of the timing clock pulse signal and store the pattern numbers in the pattern register PTN.

Then, in a step S53, a judgment is made as to whether the song end code is detected or not. IF the song end code is detected, the end flag END is set to "1" (a step S54) because the end of the song is indicated by the code. If the song end code is not detected in the step S53, the situation of the routine skips the step S54.

Then, in a step S55, pattern data corresponding to the pattern number stored in the register PTN are read from the pattern memory on the basis of the timing clock pulse signal.

The pattern data are subjected to the tone generating process in a step S57 to thereby generate performance tones.

In a step S58, a judgment is made as to whether the pattern end code is detected or not. If the pattern end code is detected, the pattern number is increased by one and at the same time the timing clock pulse signal is set to the original state in a step S59. Then, the situation of the routine returns.

If the pattern end code is not detected, the timing clock pulse signal is Increased by one and then the situation of the routine returns.

If the song play flag SPLAY is not "1" in the step 51, a judgment is made as to whether the pattern play flag PPLAY is "1" or not (a step S56) because song playing is not designated. If pattern playing is designated, the situation of the routine joins the step S55 according to the arrow of "Yes". In this step S55, pattern playing is carried out. If pattern playing is not designated, the situation of the routine returns soon.

As described above, a song can be composed while real-time performance tones are confirmed.

Although the above description is mainly made upon the case where a song concerning tones of a percussion instrument is composed, the same controlling routine can be applied to the case where a song containing melody may be composed. In the case of an electronic musical instrument only used for simulating tones of percussion instruments, the electronic musical instrument can be assembled without the keyboard 31 and the depressed key detection circuit 32 shown in FIG. 2.

In the case of mode classification shown in FIG. 5, a pattern play mode or the like may be provided as another mode. For example, such a mode in which selected patterns are played to be confirmed before the patterns are stored as a song may be provided.

Although the above description is made upon the case where the confirmation of performance tones in the song composing process is controlled by software means, the invention can be applied to the case where it may be controlled by hardware means. Melody, base line, code, etc., as well as rhythm, can be used as the pattern form.

Although the above description is made upon the case where pattern numbers are stored in the song memory, the invention can be applied to the ease where pattern play data may be stored directly.

Having described the present invention as to the embodiments thereof, the invention is not limited to the specific embodiments. For example, it will be self-evident to those skilled in the art that various changes, modifications and combinations may be made.

What is claimed is:

1. An electronic musical instrument comprising:

tone generator means for generating musical tones on the basis of performance pattern data;

first memory means for storing a plurality of performance pattern data, each containing at least one measure and associated with a code;

selecting means for selecting one of the plurality of performance pattern data stored in the first memory means by an associated code;

reader means, responsive to said selecting means, for reading out the performance pattern data selected by said selecting means from the first memory means;

control means, responsive to said selecting means, for controlling said reader means and said tone generator means to supply performance pattern data read out by said reader means to said tone generator means to generate musical tones;

second memory means for storing a plurality of said codes representing performance pattern data to be read out in an order of performance;

write designating means for designating to write a code associated with a performance pattern data selected by said selecting means and generated in said tone generator means into said second memory means;

writing means for writing the code associated with the performance pattern data selected by said selecting means when said write designating means designates to write; and means responsive to writing the code associated with the performance pattern data selected by said selecting means for supplying the performance pattern data to said tone generator means to generate musical tones represented by the performance data, so that selection of the code by a composer can be verified;

whereby the electronic musical instrument is capable of composing a song by successively selecting performance pattern data from among the plurality of performance pattern data preliminarily stored in the first memory means.

2. An electronic musical instrument according to claim 1, further comprising mode designation means for designating one of a store mode for storing at least one code into said second memory means and a performance mode for reading out at least one code stored in said second memory means.

3. An electronic musical instrument according to claim 2, further comprising tone designation means for designating one of a plurality of musical tones which respectively simulate various kinds of musical instruments.

4. An electronic musical instrument according to claim 2, further comprising object designation means for designating one of said first and second memory means.

5. An electronic musical instrument according to claim 4, wherein, when said memory mode and said first memory means are designated by said mode designation means and said object designation means respectively, said control means controls said first memory means to store performance pattern data therein.

6. An electronic musical instrument according to claim 4, wherein, when said memory mode and said second memory means are designated by said mode designation means and said object designation means respectively, said control means controls said tone generator means to generate performance sound based on the performance pattern data selected by said selecting means before selected code is stored in said second memory means.

7. An electronic musical instrument according to claim 2, further comprising second reader means for successively reading, when the performance mode is selected, a plurality of codes stored in said second memory means, wherein the first reader means reads out performance pattern data corresponding to the codes successively read out from the second memory means, from the first memory means.

8. An electronic musical instrument according to claim 7, wherein said second memory means stores a plurality of songs, each song including a group of codes, and further comprising:

song designating means for designating one of the plurality of songs;

said second reader means reading out successively codes belonging to a designated song in the second memory means.

9. An electronic musical instrument according to claim 7, wherein the writing means writes a plurality of codes in a predetermined order of playing performance pattern data, and the second memory means stores the plurality of codes in the predetermined order of playing performance pattern data.

10. An electronic musical instrument according to claim 1 wherein, the writing means writes a plurality of codes in a predetermined order of playing performance pattern data, and the second memory means stores the plurality of codes in the predetermined order of playing performance pattern data.

11. An electronic musical instrument comprising:

tone generator means for generating musical tones on the basis of performance pattern data;

first memory means for storing a plurality of performance pattern data, each containing at least one measure;

selecting means for selecting one of the plurality of performance pattern data stored in the first memory means;

reader means, responsive to said selecting means, for reading out the performance pattern data selected by said selecting means from the first memory means;

control means, responsive to said selecting means, for controlling said reader means and said tone generator means to supply performance pattern data read out by said reader means to said tone generator means to generate musical tones;

second memory means for storing performance pattern data corresponding to a song;

write designating means for designating to write the performance pattern data selected by said selecting means and generated in said tone generator means, into said second memory means;

writing means for successively writing performance pattern data selected by said selecting means, in said second memory means each time said write designation means designates to write; and means responsive to writing performance pattern data selected by said selecting means for supplying the performance pattern data to said tone generator means to generate musical tones represented by the performance pattern data, so that selection of the performance pattern data by a composer can be verified;

whereby the electronic musical instrument is capable of composing a song by successively selecting performance pattern data from among the plurality of performance pattern data preliminarily stored in the first memory means.

* * * * *